US006854701B2

(12) United States Patent
Brockmann

(10) Patent No.: US 6,854,701 B2
(45) Date of Patent: Feb. 15, 2005

(54) BELT SANDER SUPPORT AND ORIENTATION APPARATUS

(76) Inventor: Raymond J. Brockmann, P.O. Box 168, Holbrook, NY (US) 11741

( * ) Notice: Subject to any disclaimer, the term of this patent is extended or adjusted under 35 U.S.C. 154(b) by 0 days.

(21) Appl. No.: 10/462,920

(22) Filed: Jun. 16, 2003

(65) Prior Publication Data

US 2004/0251393 A1 Dec. 16, 2004

(51) Int. Cl.[7] ..... F16M 9/00
(52) U.S. Cl. ..... 248/671
(58) Field of Search ..... 248/671, 163.1, 248/157, 419, 298.1; 451/340, 344, 360, 361; 144/286.1, 286.5, 286.7

(56) References Cited

U.S. PATENT DOCUMENTS 4,114,665 A * 9/1978 Decker ..... 144/286.1
5,431,206 A * 7/1995 McAllister ..... 144/286.1
6,209,597 B1 * 4/2001 Calcote ..... 144/329
2002/0043296 A1 * 4/2002 Daniels et al. ..... 144/286.5

* cited by examiner

*Primary Examiner*—Leslie A. Braun
*Assistant Examiner*—Kofi Schulterbrandt

(57) ABSTRACT

A portable power tool support and orientation apparatus includes a power tool holder member for attachment to a portable powered belt sander. A holder support supports the tool holder member. The holder support includes a first workpiece support table, riser members which support the first workpiece support table, a bottom base member which supports the riser members. A holder-reception slot is located on the bottom base member for receiving a bottom end of the tool holder member. A first mode of use is provided, with employment of a second workpiece support table assembly, when workpiece is moved in forward or backward directions coaxial with the longitudinal axis of the moving belt of the portable powered belt sander. A second mode of use is provided when the portable powered belt sander is stabilized, and the workpiece is moved in forward or backward directions perpendicular to the longitudinal axis of the moving belt.

24 Claims, 6 Drawing Sheets

FIG 1
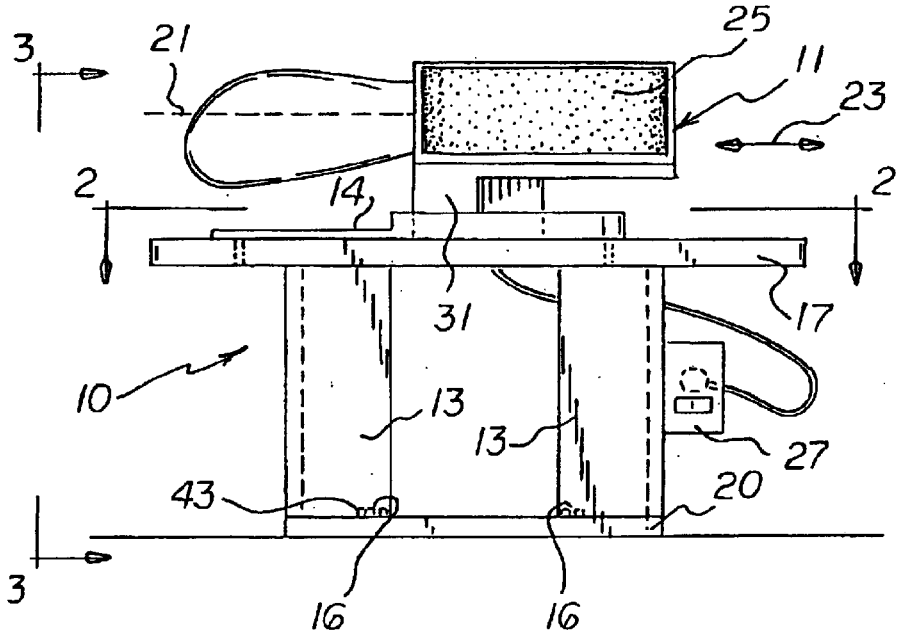
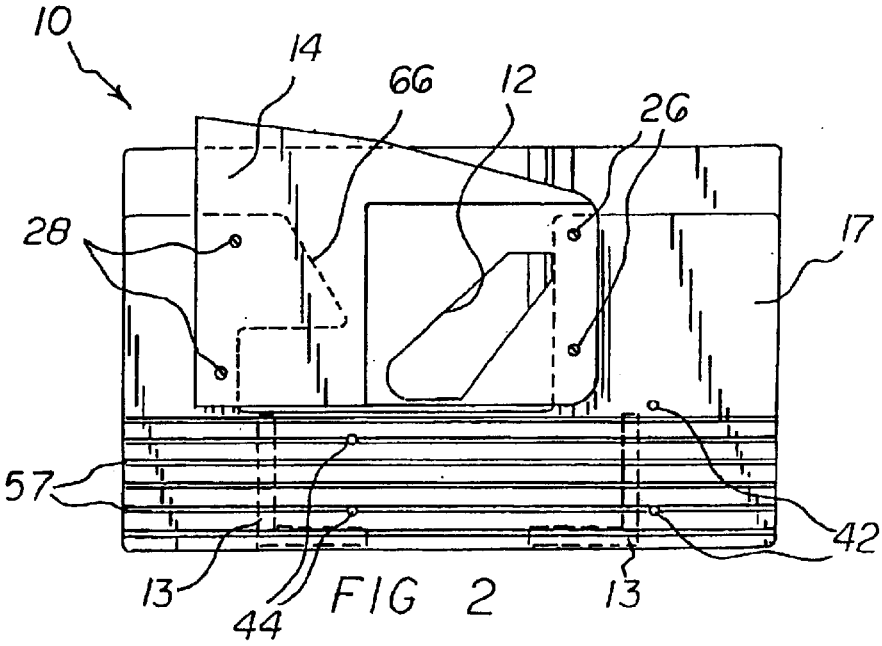
FIG 2

FIG 3
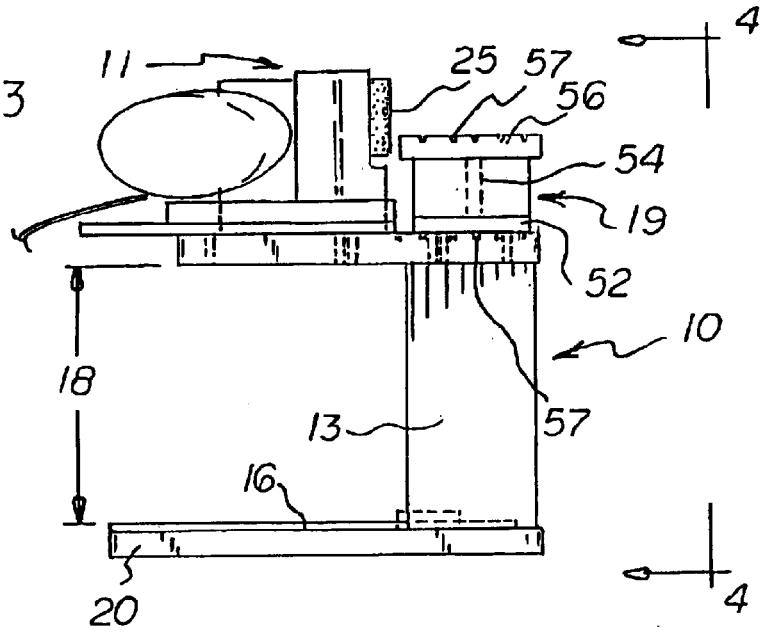
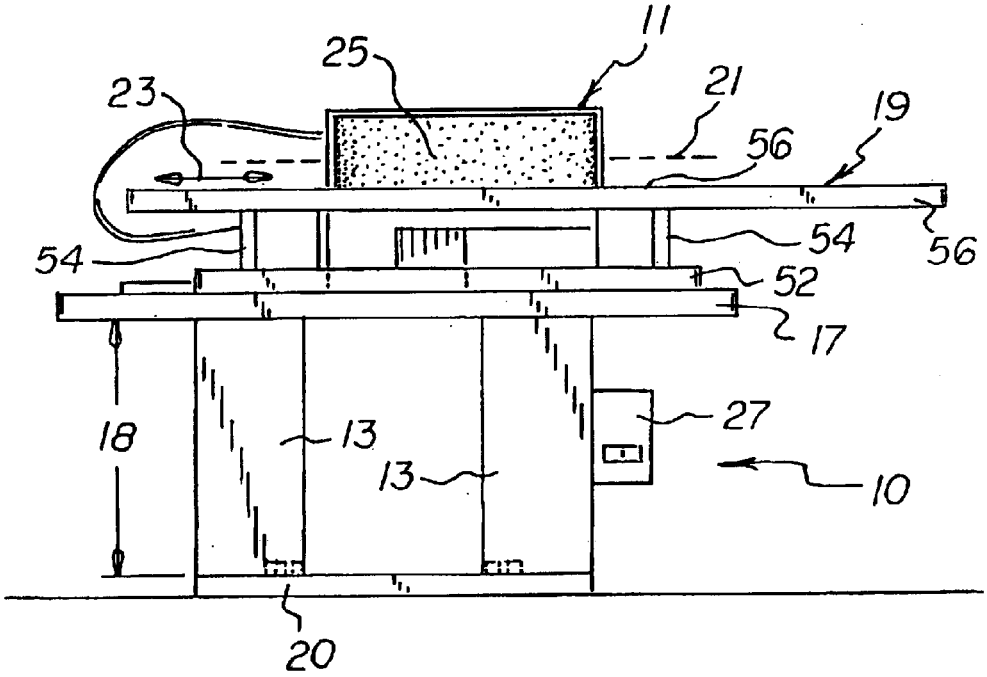
FIG 4

FIG 6
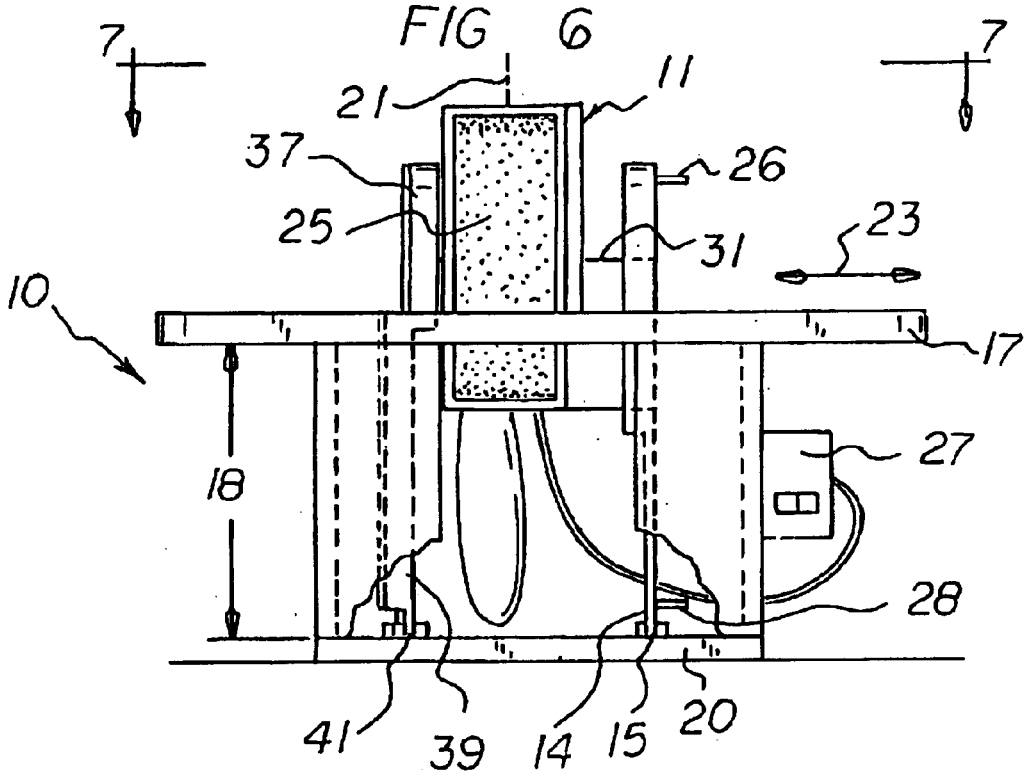
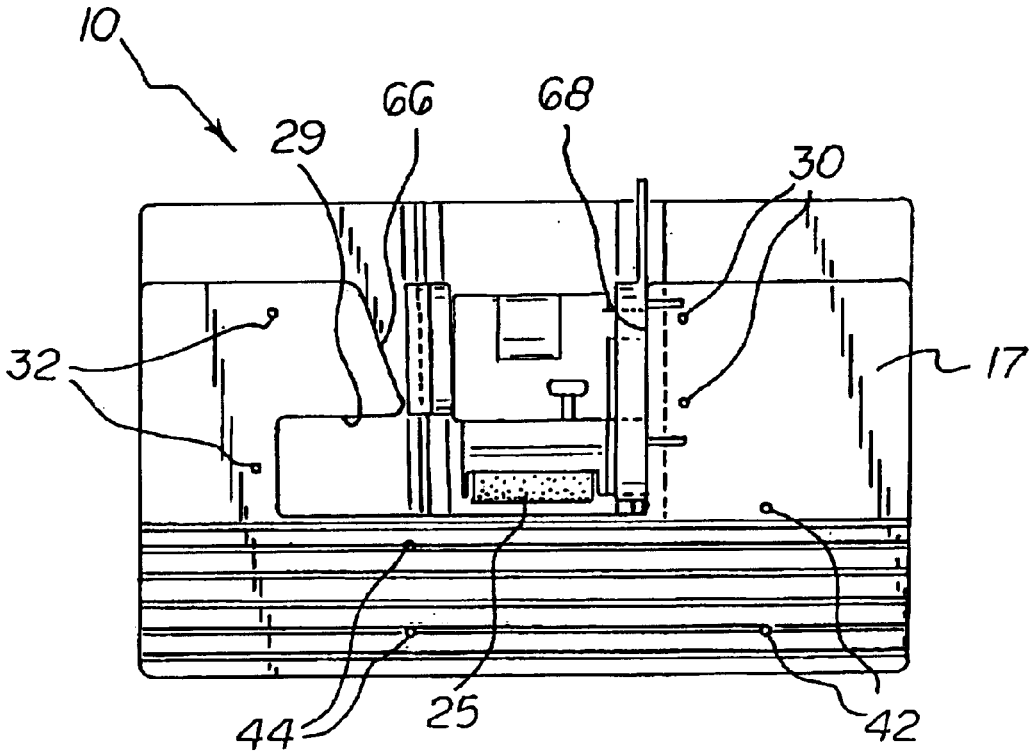
FIG 7

BELT SANDER SUPPORT AND ORIENTATION APPARATUS

BACKGROUND OF THE INVENTION

1. Field of the Invention

The present invention relates generally to machining tools and, more particularly, to adaptor apparatus especially adapted for enabling a hand-held power tool, such as a portable powered belt sander, to be used as a power tool in a hands-free manner.

2. Description of the Prior Art

In general, portable, hand-held power tools must be held by an operator with at least one, and perhaps two hands. As a result, a workpiece must be stabilized by only one hand, or perhaps no hands, as the power tool is used on the workpiece. In this respect, generally, when using a hand-held power tool, the workpiece is stabilized when the hand-held power tool is used.

In contrast, however, there are circumstances when it is more desirable for the machine tool to be stabilized and for the workpiece to be moved with respect to the machine tool. Such circumstances may relate to the size and shape of the workpiece, may relate to the weight and fatiguing characteristics of the power tool, and may relate to the vibrations or heat given off by the power tool.

Many individuals prefer to have hand-held power tools because of their cost and versatility. Yet, when it would be preferable to employ a stationary power tool and a moving workpiece, such individuals are at a loss. To overcome this deficiency, it would be desirable if a device were provided that stabilized a hand-held power tool to provide a stationary power tool so that an individual could move a workpiece with respect to the stationary power tool.

More particularly, a popular hand-held power tool is a portable powered belt sander. In this respect, it would be desirable if a device were provided that stabilized a portable powered belt sander to provide a stationary powered belt sander so that an individual could move a workpiece with respect to the stationary powered belt sander.

The belt on a portable powered belt sander generally has a relatively long length and a relatively short width, and the belt moves along the longitudinal axis of the length. The portable powered belt sander can be used in a number of modes.

In one mode of use, the portable powered belt sander is moved along the workpiece in forward or backward directions coaxial with the longitudinal axis of the moving belt. In this respect, it would be desirable if a device were provided which stabilized a portable powered belt sander so that a workpiece could be moved in forward and backward directions that are coaxial with the longitudinal axis of the moving belt of stabilized powered belt sander.

In another mode of use, the portable powered belt sander is moved along the workpiece in forward or backward directions perpendicular to the longitudinal axis of the moving belt. In this respect, it would be desirable if a device were provided which stabilized a portable powered belt sander so that a workpiece could be moved in forward and backward directions that are perpendicular to the longitudinal axis of the moving belt of stabilized powered belt sander.

Furthermore, it would be desirable if a device were provided which selectively and interchangeably stabilized a portable powered belt sander to permit selective coaxial or perpendicular movement of a workpiece with respect to the longitudinal axis of the moving belt.

When a portable powered belt sander is employed, it is often desirable to change one belt with another belt, either because a particular belt wears out or because a belt of different coarseness or fineness is desired. In this respect, it would be desirable if a stationary device for a portable powered belt sander were provided which readily permits changing one belt for another belt without disassembling the stabilizing device.

Generally, stationary power tools include a powered tool, such as a saw blade or a sanding belt, and a support for a workpiece. A clearance is provided between the powered tool and the workpiece support so that the powered tool does not damage the workpiece support. In this respect, for a device which stabilizes a portable powered belt sander, it would be desirable to provide means for assuring a clearance between the moving belt and a workpiece support.

Thus, while the foregoing discussion indicates it to be well known to use a hand-held portable powered belt sander, there is no teaching or suggestion of a belt sander support and orientation apparatus which has the following combination of desirable features: (1) provides a stabilized hand-held power tool so that an individual can move a workpiece with respect to the stationary power tool; (2) provides a stabilized portable powered belt sander so that an individual can move a workpiece with respect to the stationary powered belt sander; (3) provides a stabilized portable powered belt sander so that a workpiece can be moved in forward and backward directions that are coaxial with the longitudinal axis of the moving belt of the stabilized powered belt sander; (4) provides a stabilized portable powered belt sander so that a workpiece can be moved in forward and backward directions that are perpendicular to the longitudinal axis of the moving belt of the stabilized powered belt sander; (5) provides a selectively and interchangeably stabilized portable powered belt sander to permit selective coaxial or perpendicular movement of a workpiece with respect to the longitudinal axis of the moving belt; (6) provides a stationary device for a portable powered belt sander which readily permits changing one belt for another belt without disassembling the stabilizing device; and (7) provides means for assuring an appropriate clearance between the moving belt and a workpiece support of a stabilized portable powered belt sander. The foregoing desired characteristics are provided by the unique belt sander support and orientation apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a portable power tool support and orientation apparatus which includes power tool holder means for attachment to a portable power tool, and holder support means for receiving the power tool holder means. The holder support means include a first workpiece support table, riser members which support the first workpiece support table, a bottom base member which supports the riser members, and holder-reception means, supported by the bottom base member, for receiving a portion of the power tool holder means. An electrical outlet with on/off switch is attached to the holder support means. Preferably, the first workpiece support table includes anti-drag groove slots.

The portable power tool can be a portable powered belt sander. Preferably, the first workpiece support table includes an open, tool-access region.

More specifically, the power tool holder means include a tool holder member which includes a tool-attachment portion and a tool-elevation portion that is received in the holder-reception means. More specifically, the holder-reception means include a holder-reception slot for receiving a bottom end of the tool-elevation portion.

In general, the riser members have a riser height such that at least a portion of the portable power tool is positioned above the first workpiece support table when the bottom end of the tool-elevation portion is received in the holder-reception slot.

Preferably, a clearance-providing stop member is positioned in the holder-reception slot, for locating the tool holder member so that a working portion of the portable power tool does not operate upon the first workpiece support table.

Generally, tool locking assembly means, connected between the power tool holder means and the holder support means, can be provided for locking the power tool holder means to the holder support means in a selected mode of use.

A first mode of use is provided when the portable powered belt sander is stabilized, and the workpiece is moved in forward or backward directions coaxial with the longitudinal axis of the moving belt.

A second mode of use is provided when the portable powered belt sander is stabilized, and the workpiece is moved in forward or backward directions perpendicular to the longitudinal axis of the moving belt.

When the portable power tool is a portable powered belt sander which includes a moving belt, and when the portable powered belt sander is stabilized in a second mode of use wherein a workpiece is moved in forward or backward directions perpendicular to the longitudinal axis of the moving belt, the tool locking assembly means include a tool locking member. The tool locking member includes a tool clamping portion, an intermediate locking member portion, and a bottom locking end. The tool locking assembly means also include a locking-member-receiver, supported on the bottom base member, for receiving and securing the bottom locking end to the holder support means.

Preferably, the locking-member-receiver is in a form of a bottom-locking-end-reception slot. Preferably, the bottom-locking-end-reception slot is slightly non-parallel to the holder-reception slot, such that the tool clamping portion is wedged between the portable power tool and the first workpiece support table when the tool locking member is installed.

Preferably, the tool locking assembly means further include a sloped first inside wall and a non-sloped second inside wall on the first workpiece support table opposite to the sloped first inside wall. The sloped first inside wall and the non-sloped second inside wall are slightly non-parallel to each other.

Preferably, the non-parallelness of the locking-member-receiver to the holder-reception slot and the non-parallelness of the sloped first inside wall to the non-sloped second inside wall are similar to each other.

First alignment means are connected between the power tool holder means and the first workpiece support table for aligning the power tool holder means with respect to the first workpiece support table. Preferably, the first alignment means include a plurality of first alignment pins on the power tool holder means, and a plurality of corresponding first pin-reception wells in the first workpiece support table. More specifically, the first alignment pins include forward first alignment pins located on a forward portion of the power tool holder means and include rearward first alignment pins located on a rearward portion of the power tool holder means. In addition, the complementary first pin-reception wells include forward first pin-reception wells located on a forward portion of the first workpiece support table and include complementary rearward first pin-reception wells located on a rearward portion of the first workpiece support table.

Preferably, the forward first alignment pins are separated from each other and the forward first pin-reception wells are separated from each other by a forward first separation distance, and the rearward first alignment pins are separated from each other and the rearward first pin-reception wells are separated from each other by a rearward first separation distance. The forward first separation distance is not equal to the rearward first separation distance.

For a first mode of use in which the portable powered belt sander is stabilized, and the workpiece is moved in forward or backward directions perpendicular to the longitudinal axis of the moving belt. A second workpiece support table assembly is received upon the first workpiece support table. Preferably, the second workpiece support table includes anti-drag groove slots. Second alignment means are connected between the second workpiece support table assembly and the first workpiece support table, for aligning the second workpiece support table assembly with respect to the first workpiece support table. The second alignment means include a plurality of second alignment pins on the second workpiece support table assembly and include a plurality of corresponding second pin-reception wells in the first workpiece support table.

The second alignment pins include forward second alignment pins located on a forward portion of the second workpiece support table assembly and include rearward second alignment pins located on a rearward portion of the second workpiece support table assembly. The second pin-reception wells include forward second pin-reception wells located on a forward portion of the first workpiece support table and include rearward second pin-reception wells located on a rearward portion of the first workpiece support table.

The forward second alignment pins are separated from each other and the forward second pin-reception wells are separated from each other by a forward second separation distance. The rearward second alignment pins are separated from each other and the rearward second pin-reception wells are separated from each other by a rearward second separation distance. The forward second separation distance is not equal to the rearward second separation distance.

Preferably, the second workpiece support table assembly includes a second base member which includes the forward second alignment pins and the rearward second alignment pins, includes second riser members projecting upward from the second base member, and includes a second workpiece support table supported by the second riser members.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved belt sander support and orientation apparatus which has all of the advantages of the prior art and none of the disadvantages.

It is another object of the present invention to provide a new and improved belt sander support and orientation apparatus which may be easily and efficiently manufactured and marketed.

It is a further object of the present invention to provide a new and improved belt sander support and orientation apparatus which is of durable and reliable construction.

An even further object of the present invention is to provide a new and improved belt sander support and orientation apparatus which is susceptible of a low cost of manufacture with regard to both materials and labor, and which accordingly is then susceptible of low prices of sale to the consuming public, thereby making such belt sander support and orientation apparatus available to the buying public.

Still yet a further object of the present invention is to provide a new and improved hand-held power tool support and orientation apparatus which provides a stabilized hand-held power tool so that an individual can move a workpiece with respect to the stationary power tool.

Still another object of the present invention is to provide a new and improved belt sander support and orientation apparatus that provides a stabilized portable powered belt sander so that an individual can move a workpiece with respect to the stationary powered belt sander.

Yet another object of the present invention is to provide a new and improved belt sander support and orientation apparatus which provides a stabilized portable powered belt sander so that a workpiece can be moved in forward and backward directions that are coaxial with the longitudinal axis of the moving belt of the stabilized powered belt sander.

Even another object of the present invention is to provide a new and improved belt sander support and orientation apparatus that provides a stabilized portable powered belt sander so that a workpiece can be moved in forward and backward directions that are perpendicular to the longitudinal axis of the moving belt of the stabilized powered belt sander.

Still a further object of the present invention is to provide a new and improved belt sander support and orientation apparatus which provides a selectively and interchangeably stabilized portable powered belt sander to permit selective coaxial or perpendicular movement of a workpiece with respect to the longitudinal axis of the moving belt.

Yet another object of the present invention is to provide a new and improved belt sander support and orientation apparatus that provides a stationary device for a portable powered belt sander which readily permits changing one belt for another belt without disassembling the stabilizing device.

Still another object of the present invention is to provide a new and improved belt sander support and orientation apparatus which provides means for assuring an appropriate clearance between the moving belt and a workpiece support of a stabilized portable powered belt sander.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a front view showing a partially assembled preferred embodiment of the belt sander support and orientation apparatus of the invention set up for a first mode of use wherein the portable powered belt sander is stabilized, and wherein the workpiece is moved in forward or backward directions coaxial with the longitudinal axis of the moving belt.

FIG. 2 is a top view of the embodiment of the partially assembled belt sander support and orientation apparatus shown in FIG. 1 taken along line 2—2 of FIG. 1.

FIG. 3 is a side view of the embodiment of a fully assembled belt sander support and orientation apparatus of FIG. 1 taken along line 3—3 thereof.

FIG. 4 is a front view of the filly assembled of the embodiment of the invention shown in FIG. 3 taken along line 4—4 of FIG. 3.

FIG. 6 is a front view of a fully assembled preferred embodiment of the belt sander support and orientation apparatus of the invention set up for a second mode of use wherein the portable powered belt sander is stabilized, and wherein the workpiece is moved in forward or backward directions perpendicular to the longitudinal axis of the moving belt.

FIG. 7 is a top view of the embodiment of the invention shown in FIG. 6 taken along line 7—7 thereof.

DESCRIPTION OF THE PREFERRED EMBODIMENT

With reference to the drawings, a new and improved belt sander support and orientation apparatus embodying the principles and concepts of the present invention will be described.

Figure 8:
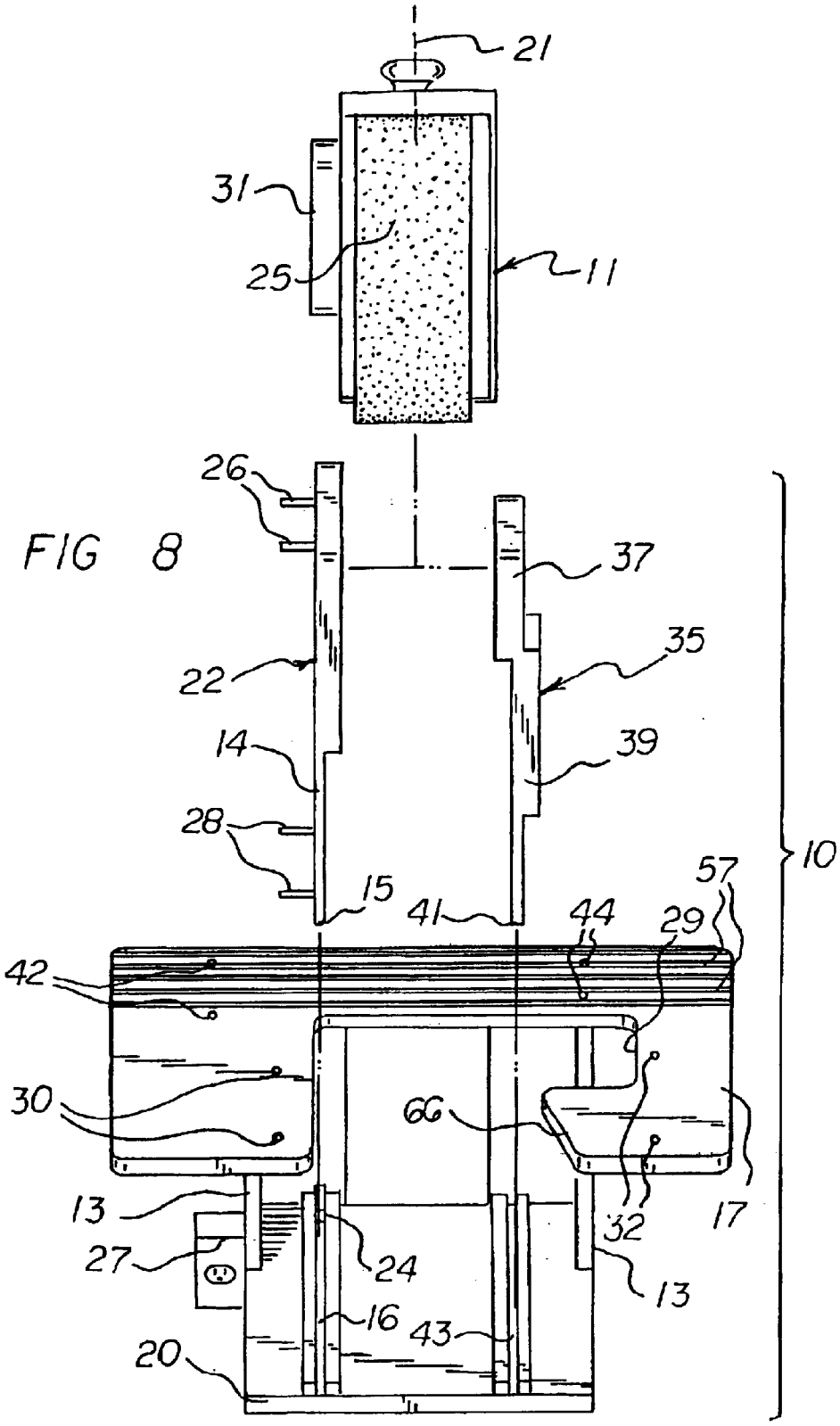
FIG. 8 is an exploded view of the embodiment of the invention shown in FIGS. 6 and 7.
Figure 9:
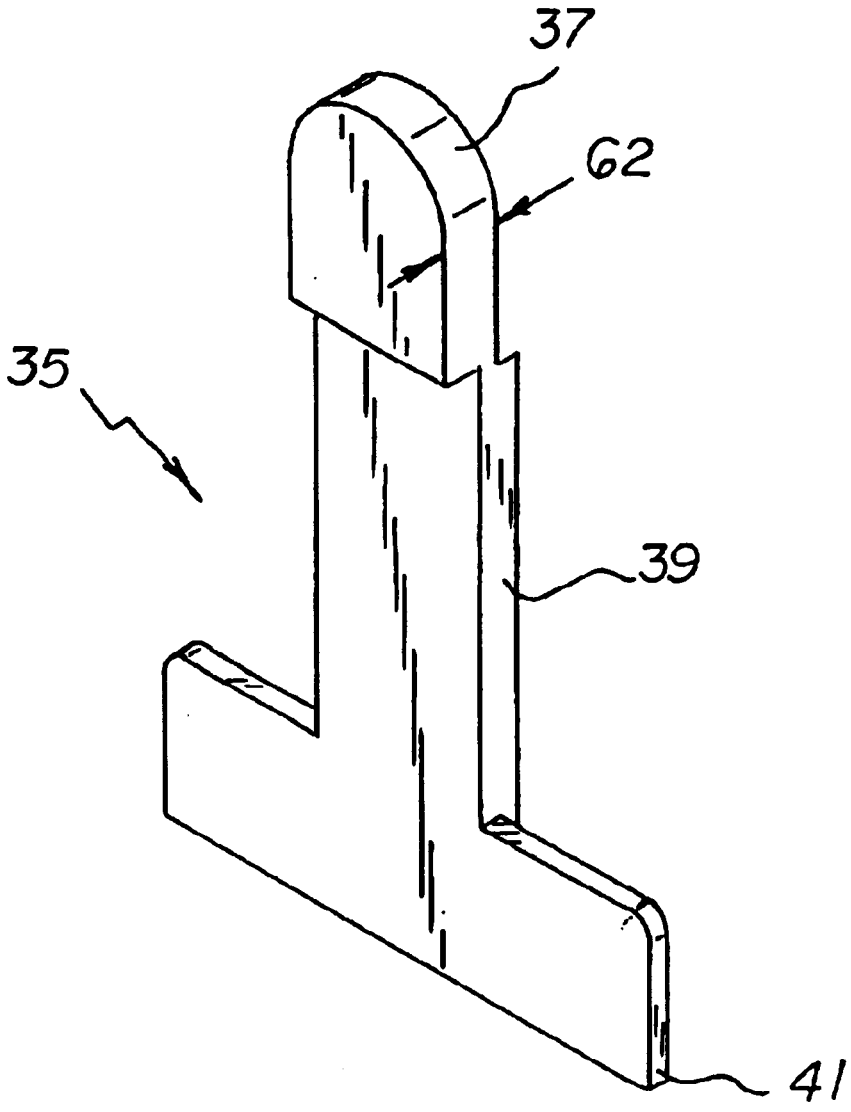
FIG. 9 is a side perspective view of a tool locking member of the invention used in FIGS. 6–8.

Turning to FIGS. 1–8, a preferred embodiment of the belt sander support and orientation apparatus of the invention generally designated by reference numeral 10. For the embodiment of the invention shown, a first mode of use is shown in FIGS. 1–5, and a second mode of use is shown in FIGS. 6–8.

The portable power tool support and orientation apparatus 10 includes power tool holder means for attachment to a portable power tool, and holder support means for receiving the power tool holder means. The holder support means include a first workpiece support table 17, riser members 13 which support the first workpiece support table 17, a bottom base member 20 which supports the riser members 13, and holder-reception means, supported by the bottom base member 20, for receiving a portion of the power tool holder means. An electrical outlet with on/off switch 27 is attached to the holder support means. Preferably, the first workpiece support table 17 includes anti-drag groove slots 57. The anti-drag groove slots 57 reduce drag of a work piece on the first workpiece support table 17.

The portable power tool can be a conventional portable powered belt sander 11.

Preferably, the first workpiece support table 17 includes an open, tool-access region 29. When the apparatus of the invention is used in the second mode of use with a portable powered belt sander 11, the open, tool-access region 29 permits an operator to change a sanding belt without disassembling the portable powered belt sander 11 from the holder support means. To change a sanding belt, the operator can use one or more of his hands through the open, tool-access region 29 to change the belt without disassembling the apparatus of the invention.

More specifically, the power tool holder means include a tool holder member 22 which includes a tool-attachment portion 12 and a tool-elevation portion 14 that is received in the holder-reception means. More specifically, the holder-reception means include a holder-reception slot 16 for receiving a bottom end 15 of the tool-elevation portion 14.

As shown in the embodiment of the invention illustrated in FIGS. 6–8, a preferred embodiment of the belt sander support and orientation apparatus of the invention is set up for a second mode of use wherein the portable powered belt sander is stabilized, and wherein a workpiece (not shown) is moved in forward or backward directions, shown by bidirectional arrow 23, which are perpendicular to the longitudinal axis 21 of the moving belt 25.

In general, the riser members 13 have a riser height 18 such that at least a portion of the portable power tool is positioned above the first workpiece support table 17 when the bottom end of the tool-elevation portion 14 is received in the holder-reception slot 16.

Preferably, a clearance-providing stop member 24 is positioned in the holder-reception slot 16, for locating the tool holder member 22 so that a working portion of the portable power tool does not operate upon the first workpiece support table 17. The clearance-providing stop member 24 provides a ⅛ inch gap between the moving belt 25 of the portable powered belt sander 11 and the first workpiece support table 17.

Generally, tool locking assembly means, connected between the power tool holder means and the holder support means, can be provided for locking the power tool holder means to the holder support means in a selected mode of use.

More specifically, as shown in FIGS. 6–8, when the portable power tool is a portable powered belt sander 11 which includes a moving belt 25, and when the portable powered belt sander 11 is stabilized in a second mode of use wherein a workpiece is moved in forward or backward directions perpendicular to the longitudinal axis of the moving belt 25, the tool locking assembly means include tool locking member 35. Tool locking member 35 includes a tool clamping portion 37, an intermediate locking member portion 39, and a bottom locking end 41. The tool locking assembly means also include a locking-member-receiver 43, supported on the bottom base member 20, for receiving and securing the bottom locking end 41 to the holder support means.

Preferably, the locking-member-receiver 43 is in a form of a bottom-locking-end-reception slot 43. Preferably, the bottom-locking-end-reception slot 43 is slightly non-parallel to the holder-reception slot 16, such that the tool clamping portion 37 is wedged between the portable power tool and the first workpiece support table 17 when the tool locking member 35 is installed.

Preferably, the tool locking assembly means further includes a sloped first inside wall 66 and a non-sloped second inside wall 68 on the first workpiece support table 17 opposite to the sloped first inside wall 66. The sloped first inside wall 66 and the non-sloped second inside wall 68 are slightly non-parallel to each other.

The non-parallelness of the locking-member-receiver 43 to the holder-reception slot 16 and the non-parallelness of the sloped first inside wall 66 to the non-sloped second inside wall 68 are similar to each other.

Figure 5:
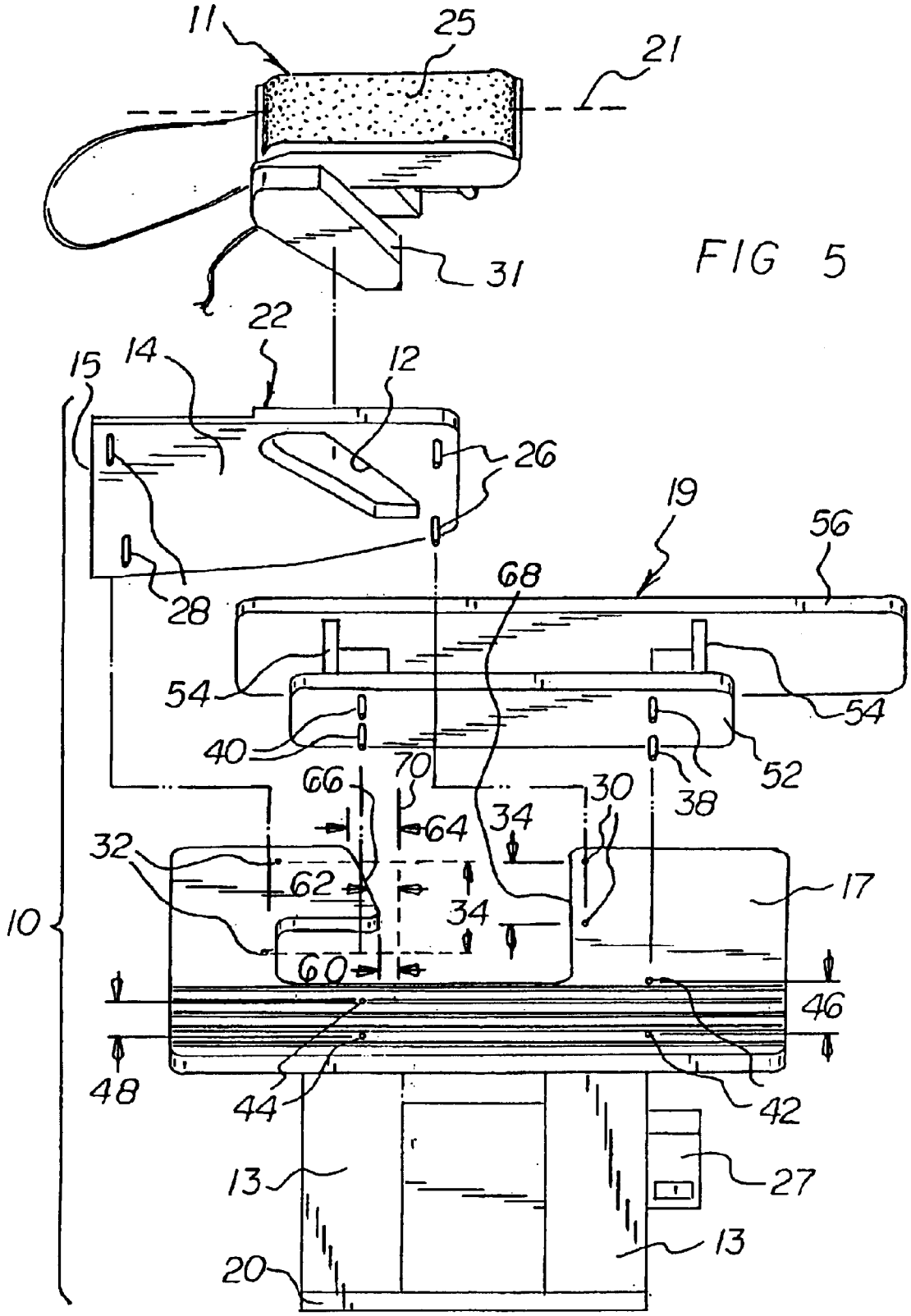
FIG. 5 is an exploded view of the embodiment of the invention shown in FIG. 4.

Prior to placing the portable powered belt sander 11 in locked position in the mode of use wherein the portable powered belt sander is moved along the workpiece in forward or backward directions perpendicular to the longitudinal axis of the moving belt, the sloped first inside wall 66 of the first workpiece support table 17 provides a tight clamping distance 60, a distance 62 equalling the thickness of the tool clamping portion 37, and a relatively wide tool entry distance 64 as shown in FIG. 5. The tight clamping distance 60, the distance 62, and the relatively wide tool entry distance 64 are shown in FIG. 5 relative to line 70 which shows the approximate position of the portable powered belt sander 11 when the portable powered belt sander 11 is installed in the apparatus. When the tool locking member 35 is placed in position for locking the portable powered belt sander 11 into the first workpiece support table 17 and the bottom base member 20, the tool clamping portion 37, which has a thickness equalling the distance 62, first passes through the relatively wide tool entry distance 64. Then, the tool clamping portion 37 reaches the distance 62 which equals its thickness. Then, as the tool clamping portion 37 continues to be pushed into the first workpiece support table 17, the tool clamping portion 37 gets wedged into the smaller tight clamping distance 60.

Therefore, the portable powered belt sander 11 is tightly locked into the bottom base member 20 with the wedging of the bottom locking end 41 of the tool locking member 35 with respect to the locking-member-receiver 43 and is tightly locked into the first workpiece support table 17 with the wedging of the tool clamping portion 37 into the tight clamping distance 60 between the sloped inside wall 66 of the first workpiece support table 17 and the portable powered belt sander 11.

First alignment means are connected between the power tool holder means and the first workpiece support table 17 for aligning the power tool holder means with respect to the first workpiece support table 17. Preferably, the first alignment means include a plurality of first alignment pins on the power tool holder means, and a plurality of corresponding first pin-reception wells in the first workpiece support table 17.

More specifically, the first alignment pins include forward first alignment pin s 26 located on a forward portion of the power tool holder means and include rearward first alignment pins 28 located on a rearward portion of the power tool holder means. In addition, the complementary first pin-reception wells include forward first pin-reception wells 30 located on a forward portion of the first workpiece support table 17 and include complementary rearward first pin-reception wells 32 located on a rearward portion of the first workpiece support table 17.

Preferably, the forward first alignment pins 26 are separated from each other and the forward first pin-reception wells 30 are separated from each other by a forward first separation distance 34, and the rearward first alignment pins 28 are separated from each other and the rearward first pin-reception wells 32 are separated from each other by a rearward first separation distance 36. The forward first separation distance 34 is not equal to the rearward first separation distance 36. Because the forward first separation distance 34 is not equal to the rearward first separation distance 36, the positioning of the tool holder member 22 on the first workpiece support table 17 can only be accomplished in one position, the proper position.

A second workpiece support table assembly 19 is received upon the first workpiece support table 17. Second alignment means are connected between the second workpiece support table assembly 19 and the first workpiece support table 17, for aligning the second workpiece support table assembly 19 with respect to the first workpiece support table 17. The second alignment means include a plurality of second alignment pins on the second workpiece support table assembly 19 and include a plurality of corresponding second pin-reception wells in the first workpiece support table 17.

The second alignment pins include forward second alignment pins 38 located on a forward portion of the second workpiece support table assembly 19 and include rearward second alignment pins 40 located on a rearward portion of the second workpiece support table assembly 19. The second pin-reception wells include forward second pin-reception wells 42 located on a forward portion of the first workpiece support table 17 and include rearward second pin-reception wells 44 located on a rearward portion of the first workpiece support table 17.

The forward second alignment pins 38 are separated from each other and the forward second pin-reception wells 42 are separated from each other by a forward second separation distance 46. The rearward second alignment pins 40 are separated from each other and the rearward second pin-reception wells 44 are separated from each other by a rearward second separation distance 48. The forward second separation distance 46 is not equal to the rearward second separation distance 48. Because the forward second separation distance 46 and the forward second alignment pins 38 are not equal, the positioning of the second workpiece support table assembly 19 on the first workpiece support table 17 can only be done with one position, the proper position.

Moreover, the positioning of the forward second pin-reception wells 42 and the rearward second pin-reception wells 44, and the corresponding respective forward second alignment pins 38 and rearward second alignment pins 40, is provided such that when the second workpiece support table assembly 19 is installed on the first workpiece support table 17, the second workpiece support table assembly 19 is set off from the moving belt 25 of the portable powered belt sander 11 by a predetermined clearance, such as ⅛ inch clearance. This clearance prevents the moving belt 25 from damaging the second workpiece support table assembly 19.

Preferably, the second workpiece support table assembly 19 includes a second base member 52 which includes the forward second alignment pins 38 and the rearward second alignment pins 40, includes second riser members 54 projecting upward from the second base member 52, and includes a second workpiece support table 56 supported by the second riser members 54. The respective thicknesses of the second base member 52 and the second workpiece support table 56, and the respective lengths of the second riser members 54 are selected such that the top surface of the second workpiece support table 56 is above at least a portion of the stabilized portable powered belt sander 11 when the stabilized portable powered belt sander 11 which is positioned in a first mode of use wherein the workpiece is moved in forward or backward directions coaxial with the longitudinal axis of the moving belt of the stabilized portable powered belt sander.

Preferably, the second workpiece support table 56 includes anti-drag groove slots 57. The anti-drag groove slots 57 reduce drag of a work piece on the second workpiece support table 56.

To use the portable power tool support and orientation apparatus 10 for a portable powered belt sander 11 in the first mode of use, as shown in FIGS. 1–5, the drive cover box 31 of the portable powered belt sander 11 is inserted into the tool-attachment portion 12 of the tool holder member 22. If desired, the tool holder member 22 could be adapted to receive another portion of the portable powered belt sander 11. The drive cover box 31 can fit into the tool-attachment portion 12 with a friction fit. The second workpiece support table assembly 19 is fitted onto the first workpiece support table 17 by inserting the forward second alignment pins 38 and the rearward second alignment pins 40 into the respective forward second pin-reception wells 42 and rearward second pin-reception wells 44 on the first workpiece support table 17. In this way, an elevated second workpiece support table 56 is provided for a workpiece (not shown). Then, the forward first alignment pins 26 and the rearward first alignment pins 28 are inserted in the respective forward first pin-reception wells 30 and rearward first pin-reception wells 32 in the first workpiece support table 17. As a result, the second workpiece support table assembly 19 is stabilized on the first workpiece support table 17. In addition, the tool holder member 22, with the portable powered belt sander 11 held therein, is supported on the first workpiece support table 17. Moreover, the moving belt 25 of the portable powered belt sander 11 is spaced from the second workpiece support table assembly 19 by a predetermined clearance, which can be ⅛ inch.

Then, the on/off switch on the portable powered belt sander 11 can be turned to the "on" position, the electrical outlet with on/off switch 27 is turned to the "off" position, and the plug for the portable powered belt sander 11 is plugged into the electrical outlet with on/off switch 27. Then, when it is desired to activate the portable powered belt sander 11, the electrical outlet with on/off switch 27 is turned to the "on" position. With the first mode of use, a workpiece is moved coaxial with the longitudinal axis 21 of the moving belt 25 as shown by bidirectional arrow 23.

To deactuate the portable powered belt sander 11, the electrical outlet with on/off switch 27 is turned to the "off" position.

To change the stabilized orientation of the portable powered belt sander 11 from the first mode of use to the second mode of use, shown in FIGS. 6–8. In the second mode of use, the longitudinal axis 21 of the moving belt 25 is perpendicular to the direction of movement of a workpiece as shown by bidirectional arrow 23. Also, the second workpiece support table assembly 19 is removed from the first workpiece support table 17. Then, the tool holder member 22 containing the portable powered belt sander 11 is lifted off of the first workpiece support table 17. Then, the bottom end 15 of the tool holder member 22 is inserted into the holder-reception slot 16. The tool holder member 22 is pushed forward until the tool-elevation portion 14 of the tool holder member 22 reaches the clearance-providing stop member 24. Then, the bottom locking end 41 of the tool locking member 35 is inserted into the bottom-locking-end-reception slot 43. The tool locking member 35 is pushed forward so that the tool clamping portion 37 of the tool locking member 35 is wedged between the portable powered belt sander 11 and the first workpiece support table 17. In this way, the portable powered belt sander 11 is firmly stabilized in the holder support means in for the second mode of use. Then, the electrical outlet with on/off switch 27 can be turned "on" to operate the moving belt 25 of the portable powered belt sander 11.

For storage purposes, the tool locking member 35 and the tool holder member 22 can be removed from the holder support means, the portable powered belt sander 11 can be pulled out from the tool holder member 22, and all of the components of the portable power tool support and orientation apparatus 10 of the invention can be stored together.

If desired, from storage, the portable power tool support and orientation apparatus 10 can be assembled directly for use in the second mode of use, without previously setting up for the first mode of use.

The components of the belt sander support and orientation apparatus of the invention can be made from inexpensive and durable metal, wooden, and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved hand-held power tool support and orientation apparatus that is low in cost, relatively simple in design and operation, and which may advantageously be used to provide a stabilized hand-held power tool so that an individual can move a workpiece with respect to the stationary power tool. With the invention, a belt sander support and orientation apparatus provides a stabilized portable powered belt sander so that an individual can move a workpiece with respect to the stationary powered belt sander. With the invention, a belt sander support and orientation apparatus provides a stabilized portable powered belt sander so that a workpiece can be moved in forward and backward directions that are coaxial with the longitudinal axis of the moving belt of the stabilized powered belt sander. With the invention, a belt sander support and orientation apparatus provides a stabilized portable powered belt sander so that a workpiece can be moved in forward and backward directions that are perpendicular to the longitudinal axis of the moving belt of the stabilized powered belt sander. With the invention, a belt sander support and orientation apparatus provides a selectively and interchangeably stabilized portable powered belt sander to permit selective coaxial or perpendicular movement of a workpiece with respect to the longitudinal axis of the moving belt. With the invention, a belt sander support and orientation apparatus provides a stationary device for a portable powered belt sander which readily permits changing one belt for another belt without disassembling the stabilizing device. With the invention, a belt sander support and orientation apparatus is provided which provides means for assuring an appropriate clearance between the moving belt and a workpiece support of a stabilized portable powered belt sander.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed is:

1. A portable power tool support and orientation apparatus, comprising:

power tool holder means for attachment to a portable power tool, holder support means for receiving said power tool holder means, wherein said holder support means include a first workpiece support table, riser members which support said first workpiece support table, a bottom base member which supports said riser members, and holder-reception means, supported by said bottom base member, for receiving a portion of said power tool holder means, and wherein:

said power tool holder means include a tool holder member which includes a tool-attachment portion and a tool-elevation portion that is received in said holder-reception means, said holder-reception means include a holder-reception slot for receiving a bottom end of said tool-elevation portion, said riser members have a riser height such that at least a portion of the portable power tool is positioned above said first workpiece support table when said bottom end of said tool-elevation portion is received in said holder-reception slot.

2. The apparatus of claim 1, further including:

an electrical outlet with on/off switch attached to said holder support means.

3. The apparatus of claim 1 wherein said portable power tool is a portable powered belt sander.

4. The apparatus of claim 1 wherein:

the portable power tool is a portable powered belt sander which includes a moving belt, and a selected mode of use is a second mode of use wherein the portable powered belt sander is stabilized, and wherein a workpiece is moved in forward or backward directions perpendicular to the longitudinal axis of the moving belt of the portable powered belt sander.

5. The apparatus of claim 1 wherein said first workpiece support table includes an open, tool-access region.

6. The apparatus of claim 1 wherein said first workpiece support table includes anti-drag groove slots.

7. The apparatus of claim 1, further including:

a clearance-providing stop member, positioned in said holder-reception slot, for locating said tool holder member so that a working portion of said portable power tool does not operate upon said first workpiece support table.

8. The apparatus of claim 1, further including:

tool locking assembly means, connected between said power tool holder means and said holder support means, for locking said tool locking assembly means to said holder support means in a selected mode of use.

9. The apparatus of claim 8 wherein said tool locking assembly means include:

tool locking member which includes a tool clamping portion, an intermediate locking member portion, and a bottom locking end, and locking-member-receiver, supported on said bottom base member, for receiving and securing said bottom locking end to said holder support means.

10. The apparatus of claim 9 wherein said locking-member-receiver is in a form of a bottom-locking-end-reception slot.

11. A portable power tool support and orientation apparatus, comprising:

power tool holder means for attachment to a portable power tool, holder support means for receiving said power tool holder means, wherein said holder support means include a first workpiece support table, riser members which support said first workpiece support table, a bottom base member which supports said riser members, and holder-reception means, supported by said bottom base member, for receiving a portion of said power tool holder means, said apparatus further including:

tool locking assembly means, connected between said power tool holder means and said holder support means, for locking said tool locking assembly means to said holder support means in a selected mode of use, wherein said tool locking assembly means include:

tool locking member which includes a tool clamping portion, an intermediate locking member portion, and a bottom locking end, and locking-member-receiver, supported on said bottom base member, for receiving and securing said bottom locking end to said holder support means, wherein said locking-member-receiver is in a form of a bottom-locking-end-reception slot, and wherein said bottom-locking-end-reception slot is slightly non-parallel to said holder-reception slot, such that said tool clamping portion is wedged between the portable power tool and said first workpiece support table when said tool locking member is installed.

12. The apparatus of claim 11 wherein said tool locking assembly means further include a sloped first inside wall and a non-sloped second inside wall on said first workpiece support table opposite to said sloped first inside wall.

13. The apparatus of claim 12 wherein said sloped first inside wall and said non-sloped second inside wall are slightly non-parallel to each other.

14. The apparatus of claim 1, further including:

first alignment means, connected between said power tool holder means and said first workpiece support table, for aligning said power tool holder means with respect to said first workpiece support table.

15. A portable power tool support and orientation apparatus, comprising:

power tool holder means for attachment to a portable power tool, holder support means for receiving said power tool holder means, wherein said holder support means include a first workpiece support table, riser members which support said first workpiece support table, a bottom base member which supports said riser members, and holder-reception means, supported by said bottom base member, for receiving a portion of said power tool holder means, said apparatus further including:

first alignment means, connected between said power tool holder means and said first workpiece support table, for aligning said power tool holder means with respect to said first workpiece support table, and wherein said first alignment means include:

a plurality of first alignment pins on said power tool holder means, and a plurality of corresponding first pin-reception wells in said first workpiece support table.

16. The apparatus of claim 15 wherein:

said first alignment pins include forward first alignment pins located on a forward portion of said power tool holder means and include rearward first alignment pins located on a rearward portion of said power tool holder means, and said first pin-reception wells include forward first pin-reception wells located on a forward portion of said first workpiece support table and include rearward first pin-reception wells located on a rearward portion of said first workpiece support table.

17. The apparatus of claim 16 wherein:

said forward first alignment pins are separated from each other and said forward first pin-reception wells are separated from each other by a forward first separation distance, said rearward first alignment pins are separated from each other and said rearward first pin-reception wells are separated from each other by a rearward first separation distance, and said forward first separation distance is not equal to said rearward first separation distance.

18. The apparatus of claim 15, further including:

a second workpiece support table assembly received upon said first workpiece support table.

19. The apparatus of claim 18, further including:

second alignment means, connected between said second workpiece support table assembly and said first workpiece support table, for aligning said second workpiece support table assembly with respect to said first workpiece support table.

20. The apparatus of claim 19 wherein said second alignment means include:

a plurality of second alignment pins on said second workpiece support table assembly, and a plurality of corresponding second pin-reception wells in said first workpiece support table.

21. The apparatus of claim 20 wherein:

said second alignment pins include forward second alignment pins located on a forward portion of said second workpiece support table assembly and include rearward second alignment pins located on a rearward portion of said second workpiece support table assembly, and said second pin-reception wells include forward second pin-reception wells located on a forward portion of said first workpiece support table and include rearward second pin-reception wells located on a rearward portion of said first workpiece support table.

22. The apparatus of claim 21 wherein:

said forward second alignment pins are separated from each other and said forward second pin-reception wells are separated from each other by a forward second separation distance, said rearward second alignment pins are separated from each other and said rearward second pin-reception wells are separated from each other by a rearward second separation distance, and said forward second separation distance is not equal to said rearward second separation distance.

23. The apparatus of claim 22 wherein said second workpiece support table assembly includes:

a second base member which includes said forward second alignment pins and said rearward second alignment pins, second riser members projecting upward from said second base member, and a second workpiece support table supported by said second riser members.

24. The apparatus of claim 18 wherein said second workpiece support table includes anti-drag groove slots.

* * * * *